US006182030B1

(12) United States Patent
Hagen et al.

(10) Patent No.: US 6,182,030 B1
(45) Date of Patent: Jan. 30, 2001

(54) ENHANCED CODING TO IMPROVE CODED COMMUNICATION SIGNALS

(75) Inventors: Roar Hagen, Stockholm; Bastiaan Kleijn, Stocksund, both of (SE)

(73) Assignee: Telefonaktiebolaget LM Ericsson (publ), Stockholm (SE)

( * ) Notice: Under 35 U.S.C. 154(b), the term of this patent shall be extended for 0 days.

(21) Appl. No.: 09/216,339

(22) Filed: Dec. 18, 1998

(51) Int. Cl.[7] ..... G10L 21/02; G08B 23/00

(52) U.S. Cl. ..... 704/201; 704/219; 704/230; D14/358; D14/496; 340/318

(58) Field of Search ..... 704/219, 230, 704/201, 200

(56) References Cited

U.S. PATENT DOCUMENTS

| | | | | |
|---|---|---|---|---|
| 4,720,861 | * | 1/1988 | Bertrand | 704/222 |
| 5,206,884 | | 4/1993 | Bhaskar | 375/34 |
| 5,327,520 | | 7/1994 | Chen | 395/2.28 |
| 5,469,527 | | 11/1995 | Drogo de Iacovo et al. | 395/2.29 |
| 5,495,555 | | 2/1996 | Swaminathan | 395/2.16 |
| 5,583,962 | * | 12/1996 | Davis et al. | 704/205 |
| 5,621,853 | | 4/1997 | Gardner | 395/2.28 |
| 5,657,420 | | 8/1997 | Jacobs et al. | 395/2.32 |
| 5,682,407 | | 10/1997 | Funaki | 375/240 |
| 5,884,010 | * | 3/1999 | Chen et al. | 704/222 |
| 5,920,832 | * | 7/1999 | Wuppermann et al. | 704/219 |

FOREIGN PATENT DOCUMENTS

| | | | |
|---|---|---|---|
| 0673014 | 9/1995 | (EP) | G10L/9/14 |

OTHER PUBLICATIONS

Kumar ("A novel multi–stage estimation of signal parameters," International Conference on Acoustics, Speech, and Signal Processing, Apr. 1990).*

Johnson et al ("Low–Complexity Multi–Mode VXC Using Multi–Stage Optimization & Mode Selection," International Conference on Acoustics, Speech and Signal Processing, Apr. 1991).*

Screenivas et al, ("Vector quantization of scale factors in advanced audio coder," Proceedings of the 1998 IEEE conference on Acoustics, Speech and Signal Processing, May 1998).*

IEEE International Conference on Acoustics, Speech, and Signal Processing, Munich, Germany, Apr. 1997, "*A Candidate Coder for the ITU–T's New Wideband Speech Coding Standard*", C. Juin–Hwey, vol. 2, pp. 1359–1362, XP002097558.

* cited by examiner

*Primary Examiner*—Richemond Dorvil
*Assistant Examiner*—Daniel A Nolan
(74) *Attorney, Agent, or Firm*—Jenkens & Gilchrist, P.C.

(57) ABSTRACT

At a transmitter of a communication system, a target signal and a primary coded signal are produced in response to an input signal. The primary coded signal is intended to match the target signal. Also produced is encoded enhancement information indicative of how closely the primary coded signal matches the target signal. At a receiver, the primary coded signal is reconstructed, the encoded enhancement information is decoded, and an enhanced reconstructed signal is produced by applying the decoded enhancement information to the reconstructed primary coded signal.

52 Claims, 10 Drawing Sheets

ENHANCED CODING TO IMPROVE CODED COMMUNICATION SIGNALS

FIELD OF THE INVENTION

The invention relates generally to coding of signals in communication systems and, more particularly, to a feature for enhancement of coded communication signals.

BACKGROUND OF THE INVENTION

High quality coding of acoustical signals at low bit rates is of pivotal importance to communications systems such as mobile telephony, secure telephone, and voice storage. In recent years, there has been a strong trend in mobile telephony towards improved quality of the reconstructed acoustical signal and towards increased flexibility in the bit rate required for transmission. The trend towards improved quality reflects, on the one hand, the customer expectation that mobile telephony provides a quality equal to that of the regular telephone network. Particularly important in this respect is the performance for background signals and music. The trend towards flexibility in bit rate reflects, on the other hand, the desire of the service providers to operate near the network capacity without the risk of having to drop calls, and possibly to have different service levels with different cost. The ability to strip bits from an existing bit stream while maintaining the ability to reconstruct the speech signal (albeit at a lower accuracy) is an especially useful type of bit rate flexibility.

With existing speech coding technology, it is difficult to meet the simultaneous challenge of improved acoustic signal quality and increased flexibility in bit rate. This difficulty is the direct result of the structure of the linear-prediction based analysis-by-synthesis (LPAS) paradigm which is commonly used in mobile telephony. Currently, LPAS coders perform better in coding speech at rates between 5 and 20 kb/s than other technologies. Accordingly, the LPAS paradigm forms the basis of virtually every digital telephony standard, including GSM, D-AMPS, and PDC. However, while the performance for speech is good, current LPAS-based speech coders do not perform as well for music and background noise signals. Furthermore, the ability to strip bits from an existing bit stream until now implied the usage of relatively low efficiency algorithms.

The LPAS coding paradigm does not perform as well for non-speech sounds because it is optimized for the description of speech. Thus, the shape of the short-term power spectrum is described as the multiplication of a spectral envelope, which is described by an all-pole model (with almost always 10 poles), and the so-called spectral fine structure, which is a combination of two components which are harmonic and noise-like in character, respectively. In practice, it is found that this model is not sufficient for many music and background-noise signals. The model shortcomings manifest themselves in perceptually inadequate descriptions of the spectral valleys (zeros), peaks which are not part of the harmonic structure in an otherwise periodic signal, and a so-called "swirling" effect in steady background noise signals which is probably caused by the time variation in the parameter estimation error.

The two main existing approaches towards developing LPAS algorithms with increased flexibility in the bit rate have significant drawbacks. In the first approach, one simply combines a number of coders operating at different bit rates and selects one coder for a particular coding time segment (examples of this first approach are the TIA IS-95 and the more recent IS-127 standards). These types of coders will be referred to as "multi-rate" coders. The disadvantage of this method is that the signal reconstruction requires the arrival at the receiver of the entire bit stream of the selected coder. Thus, the bit stream cannot be altered after it leaves the transmitter.

In the second approach, embedded coding, the encoder produces a composite bit stream made up out of two or more separate bit streams: a primary bit stream which contains a basic description of the signal, and one or more auxiliary bit streams which contain information to enhance the basic signal description. In the LPAS setting, this second approach is implemented by a decomposition of the excitation signal of the LPAS coder into a primary excitation and one or more auxiliary excitations, which enhance the excitation. However, to maintain synchronicity between the encoder and decoder (fundamental for the LPAS paradigm) at all rates, the long-term predictor (present in virtually all LPAS paradigms) can only operate on the primary excitation. Since the long-term predictor provides the most significant part of the coding gain in the LPAS paradigm, this severely limits the benefit of the auxiliary excitations. Thus, these embedded LPAS coding algorithms provide increased bit rate flexibility at the expense of significantly curtailed coding efficiency.

For coders with fixed bit rates between 5 and 20 kb/s, the well-known LPAS paradigm dominates. Overviews of this coding paradigm are provided in, for example, P. Kroon and Ed. F. Deprettere, "A class of analysis-by-synthesis predictive coders for high quality speech coding at rates between 4.8 and 16 kbit/s", *IEEE J. Selected Areas Comm.,* 6:353–363, 1988; A. Gersho, "Advances in speech and audio compression", *Proceedings IEEE,* 82:900–918, 1994; and P. Kroon and W. B. Kleijn, "Linear-prediction based analysis-by-synthesis coding", In W. B. Kleijn and K. K. Paliwal, editors, *Speech Coding and Synthesis,* pages 79–119. Elsevier Science Publishers, Amsterdam, 1995.

In the LPAS paradigm, the speech signal is reconstructed by exciting an adaptive synthesis filter with an excitation signal. The adaptive synthesis filter, which has an all-pole structure, is specified by the so-called linear prediction (LP) coefficients, which are adapted once per subframe (a subframe is typically 2 to 5 ms). The LP coefficients are estimated from the original signal once per frame (10 to 25 ms) and their value for each subframe is computed by interpolation. Information about the LP coefficients is usually transmitted once per frame. The excitation is the sum of two components: the adaptive-codebook (for the present purpose identical to the long-term predictor) contribution, and the fixed-codebook contribution.

The adaptive-codebook contribution is determined by selecting for the present subframe that segment of the past excitation which after filtering with the synthesis filter results in a reconstructed signal which is most similar to the original acoustic signal. The fixed-codebook contribution is the entry from a codebook of excitation vectors which, given the adaptive codebook contribution, renders the reconstructed signal obtained most similar to the original signal. In addition to the above process, the adaptive and fixed-codebook contributions are scaled by a quantized scaling factor.

The above description of the LPAS paradigm is applicable to almost all state-of-the-art coders. Examples of such coders are the 8 kb/s ITU G.729 (see R. Salami, C. Laflamme, J.-P. Adoul, and D. Massaloux, "A toll quality 8 kb/s speech codec for the personal communications system (PCS)", *IEEE Trans. Vehic. Techn.,* 43(3):808–816, 1994;

and R. Salami et al., "Description of the proposed ITU-T 8 kb/s speech coding standard", *Proc. IEEE Speech Coding Workshop,* pages 3–4, Annapolis, Md., 1995) and the GSM enhanced full-rate (GSMEFR) 12.2 kb/s coder (see European Telecommun. Standard Institute (ETSI), "Enhanced Full Rate (EFR) speech transcoding (GSM 06.60)", ETSI Technical Standard 300 726, 1996). Both of these coders perform well for speech signals. However, for music signals both coders contain clearly audible artifacts, more so for the lower-rate coder. For each of these coders the entire bit stream must be obtained by the receiver to allow reconstruction.

The 16 kb/s ITU G.728 coder differs from the above paradigm outline in that the LP parameters are computed from the past reconstructed signal, and thus are not required to be transmitted. This is commonly referred to as backward LP adaptation. Only a fixed codebook is used. In contrast to other coders (which use a linear prediction order of 10), a linear predication order of 50 is used. This high prediction order allows a better performance for non-speech sounds than the G.729 and GSMEFR coders. However, because of the backward adaptive structure, the coder is more sensitive to channel errors than the G.729 and GSMEFR coders, making it less attractive for mobile telephony environments. Furthermore, the entire bit stream must be obtained by the G.728 receiver to allow reconstruction.

The IS-127 of the TIA is a multi-rate coding standard aimed at mobile telephony. While this standard has increased bit-rate flexibility, it does not allow the bit stream to be modified between transmitter and receiver. Thus, the decision about the bit rate must be made in the transmitter. The coding paradigm is slightly different from the above paradigm outline, but these differences (see, e.g., D. Nahumi and W. B. Kelijn, "An improved 8 kb/s RCELP coder", *Proc. IEEE Speech Coding Workshop,* pages 39–40, Annapolis, Md., 1995; and W. B. Kleijn, P. Kroon, and D. Nahumi, "The RCELP speech coding algorithm", *European Trans. on Telecomm.,* 4(5):573–582, 1994) do not affect the accuracy of non-speech sounds significantly.

Because of the aforementioned constraints on performance with current approaches, there are only very few practical coder designs which allow the bit stream to be modified between transmitter and receiver. Some examples of these approaches are found in: R. Drogo de Iacovo and D. Sereno, "CELP coding at 6.55 kbit/s for digital mobile radio communications", *Proc. IEEE Global Telecomm. Conf.,* page 405.6, 1990; S. Zhang and G. Lockhart, "Embedded scheme for regular pulse excited (RPE) linear predictive coding", *Proc. IEEE Interrogatory. Conf. Acoust. Speech Sign. Process.,* pages 37–40, Detroit, 1995; A. Le Guyader, C. Lamblin, and E. Boursicaut, "Embedded algebraic CELP/VSELP coders for wideband speech coding", *Speech Comm.,* 16(4):219–328, 1995; and B. Tang, A. Shen, A. Alwan, and G. Pottie, "A perceptually-based embedded subband speech coder", *IEEE Trans. Speech and Audio Process.,* 5(2) :131–140, 1997. In all of these examples, the coding efficiency is low compared to fixed-rate coders because either the adaptive codebook is omitted altogether, or because the adaptive codebook operates only on the primary excitation signal. This relatively low performance of LPAS coders in using this approach is illustrated by the usage of a subband coder in recent work on embedded coding (see B. Tang, A. Shen, A. Alwan, and G. Pottie, "A perceptually-based embedded subband speech coder", *IEEE Trans. Speech and Audio Process.,* 5(2) :131–140, 1997). While subband coders do not perform as well at a fixed rate, their performance is apparently competitive when embedded coding systems are needed.

At rates above 16 kb/s, acoustic signal coders tend to be aimed at the coding of music. In contrast to the aforementioned LPAS-based coders, these higher rate coders generally use a higher sampling rate than 8 kb/s. Most of these coders are based on the well-known subband and transform coding principles. A state-of-the-art example of a hybrid multi-rate (16, 24, and 32 kb/s) coder using both linear prediction and transform coding is presented in J.-H. Chen, "A candidate coder for the ITU-T's new wideband speech coding standard", *Proc. Interrogatory. Conf. Acoust. Speech Sign. Process.,* pages 1359–1362, Atlanta, 1997. Examples of higher rate transform and subband coding schemes are given in: K. Gosse, F. Moreau de Saint-Martin, X. Durot, P. Duhamel, and J. B. Rault, "Subband audio coding with synthesis filters minimizing a perceptual distortion", *Proc. IEEE Inter. Conf. Acoust. Speech Sign. Process.,* pages 347–350, Munich, 1997; M. Purat and P. Noll, "Audio coding with dynamic wavelet packet decomposition based on frequency-varying modulated lapped transforms", *Proc. IEEE Interrogatory. Conf. Acoust. Speech Sign. Process.,* pages 1021–1024, Atlanta, 1996; J. Princen and J. Johnston, "Audio coding using signal adaptive filterbanks", *Proc. IEEE Interrogatory. Conf. Acoust. Speech Sign. Process.,* pages 3071–3074, Detroit, 1995; and N. S. Jayant, J. Johnston and R. Safranek, "Signal compression based on models of human perception", *Proc. IEEE,* 81(10) :1385–1421, 1993. Particularly at rates beyond 30 kb/s these coding procedures perform well for music and they can also be expected to do well for background noise. At lower rates, the coders suffer from either tonal or wideband noise. Unfortunately, the higher bit rates are too high for most mobile telephony applications.

At the rates commonly used for mobile telephony (8 to 16 kb/s), the performance of the transform and subband coding algorithms degrades below what can be obtained with LPAS based coding. Because of the lack of long-term feedback, these higher rate algorithms are more suited to embedded coding with conventional techniques than the LPAS coding paradigm, as is illustrated by the procedures given in B. Tang, A. Shen, A. Alwan, and G. Pottie, "A perceptually-based embedded subband speech coder", *IEEE Trans. Speech and Audio Process.,* 5(2):131–140, 1997.

The foregoing discussion illustrates two problems. The first is the relatively low performance of speech coders operating at rates below 16 kb/s, particularly for non-speech sounds such as music. The second problem is the difficulty of constructing an efficient coder (at rates applicable for mobile telephony) which allows the lowering of the bit rate between transmitter and receiver.

The first problem results from the limitations of the LPAS paradigm. The LPAS paradigm is tailored for speech signals, and, in its current form, does not perform well for other signals. While the ITU G.728 coder performs better for such non-speech signals (because it uses backward LP adaptation), it is more sensitive to channel errors, making it less attractive for mobile telephony applications. Higher rate coders (subband and transform coders) do not suffer from the aforementioned quality problems for non-speech sounds, but their bit rates are too high for mobile telephony.

The second problem results from the approach used until now for creating primary and auxiliary bit streams in LPAS coding. In this conventional approach, the excitation signal is separated into primary and auxiliary excitations. Using this approach, the long-term feedback mechanism in the LPAS coder loses in efficiency compared to non-embedded coding systems. As a result, embedded coding is rarely used for LPAS coding systems.

The functionality of the present invention provides for the estimation of enhancement information such as an adaptive equalization operator, which renders an acoustical signal (that has been coded and reconstructed with a primary coding algorithm) more similar to the original signal. The equalization operator modifies the signal by means of a linear or non-linear filtering operation, or a blockwise approximation thereof. The invention also provides the encoding of the adaptive equalization operator, while allowing for some coding error, by means of a bit stream which may be separable from the bit stream of the primary coding algorithm. The invention further provides the decoding of the adaptive equalization operator by the system receiver, and the application, at the receiver, of the decoded adaptive equalization operator to the acoustical signal that has been coded and reconstructed with a primary coding algorithm.

The adaptive equalization operator differs from postfilters (see V. Ramamoorthy and N. S. Jayant, "Enhancement of ADPCM speech by adaptive postfiltering", *AT&T Bell Labs. Tech. J.,* pages 1465–1475, 1984; and J.-H. Chen and A. Gersho, "Adaptive postfiltering for quality enhancement of coded speech", *IEEE Trans. Speech Audio Process.,* 3(1) :59–71, 1995) in that a criterion is optimized and in that information concerning the operator is transmitted. The adaptive equalization operator differs from the enhancement methods used in conventional embedded coding in that the equalization operator does not add a correction to the signal. Instead, the equalization operator is typically implemented by filtering with an adaptive filter, or by multiplying short-time spectra with a transfer function. Thus, the correction to the signal is of a multiplicative nature rather than an additive nature.

The invention allows the correction of distortion resulting from the primary encoding/decoding process for primary coders which attempt to model the signal waveform. The structure of the adaptive equalizer operator is generally chosen to address shortcomings of the primary coder structure (for example, the inadequacies in modeling non-speech sounds by LPAS coders). This addresses the first problem mentioned above.

The invention allows increased flexibility in the bit rate. In one embodiment, only the bit stream associated with the primary coder is required for reconstruction of the signal. The auxiliary bit stream associated with the adaptive equalization operator can be omitted anywhere between transmitter and receiver. The reconstructed signal will be enhanced whenever the auxiliary bit stream reaches the decoder. In another embodiment, the bit stream associated with the adaptive equalization operator is required at the receiver and therefore cannot be omitted.

DETAILED DESCRIPTION

Figure 1:
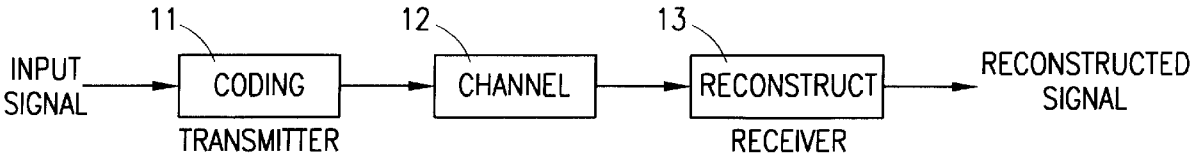
FIG. 1 (PRIOR ART)
FIG. 1 illustrates a portion of a conventional speech coding system.

Example FIG. 1 is a general block diagram of a conventional communication system. In FIG. 1, the input signal is subjected to a coding process at 11 in the transmitter. Coded information output from the transmitter passes through a communications channel 12 to the receiver, which then attempts at 13 to produce from the coded information a reconstructed signal that represents the input signal. However, and as discussed above, many conventional systems such as shown in FIG. 1, for example, speech coding systems applied in mobile telephony, do not perform well under all conditions. For example, when processing non-speech signals in an LPAS system, the reconstructed signal often does not provide an acceptable representation of the input signal.

Figure 2:
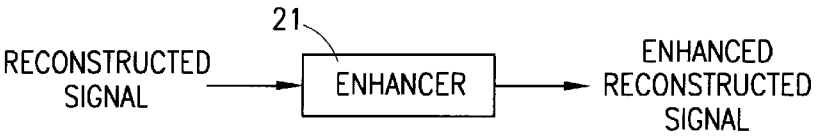
FIG. 2 illustrates diagrammatically an enhancement function according to the present invention.

The present invention provides in example FIG. 2 an enhancement function (enhancer 21) which is applied to the reconstructed signal of FIG. 1 to produce an enhanced reconstructed signal as shown in FIG. 2. The enhanced reconstructed signal output from the enhancer of FIG. 2 will typically provide a better representation of the input signal than will the reconstructed signal of FIG. 1.

Figure 3:
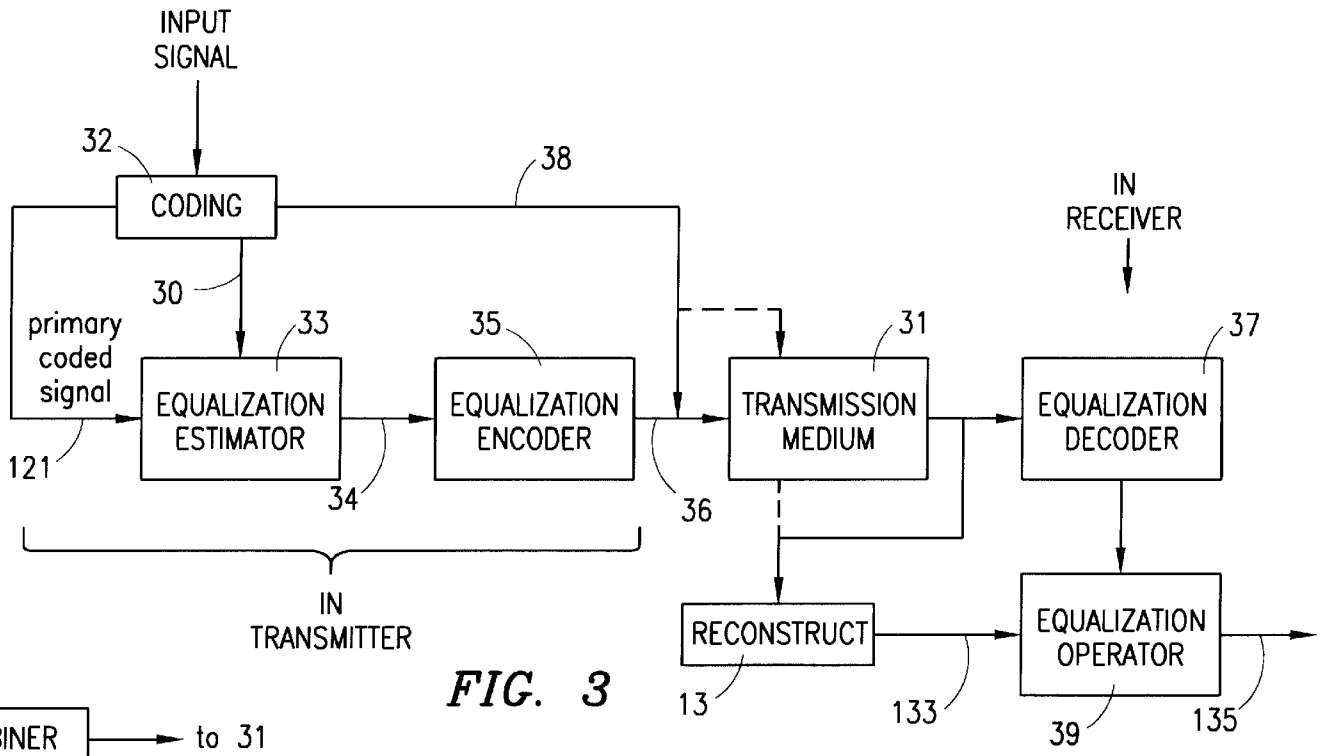
FIG. 3 illustrates diagrammatically an LPAS speech coding system including an example of the enhancement function of FIG. 2.

FIG. 3 illustrates an example of how the enhancement function of FIG. 2 may be implemented as a coded equalization operation. In FIG. 3, the signal at 133 corresponds to the reconstructed signal of FIGS. 1 and 2, the equalization operator (or equalizer) 39 corresponds to the enhancer of FIG. 2, and the signal at 135 corresponds to the enhanced reconstructed signal of FIG. 2. The transmission medium 31 of FIG. 3 corresponds to the channel 12 of FIG. 1.

An equalization estimator 33 and an equalization encoder 35 are provided in the transmitter, and an equalization decoder 37 and the equalization operator 39 are provided in the receiver. A primary coded signal 121 is produced at 32 by the conventional primary coding process of the transmitter. The primary coded signal is a coded representation of the input signal. The primary coder at 32 also outputs a target signal 30. The primary coded signal 121 is intended to match as closely as possible the target signal 30. The primary coded signal 121 and the target signal 30 are input to the equalization estimator 33. The output of the estimator 33 is then applied to the encoder 35.

A bit stream 38 output from the primary coder 32 includes information which the reconstructing process of the receiver will use at 13 to reconstruct the primary coded signal at 133. A bit stream 36 output from the encoder 35 can be combined with bit stream 38 by a conventional combining operation (see FIG. 3A) to produce a composite bit stream that passes through the transmission medium 31. The composite bit stream is received at the receiver and separated into its constituent signals by a conventional separating operation (see FIG. 3B). The bit stream containing the information for reconstructing the primary coded signal is input to the reconstructor 13, and the bit stream containing the equalization information is input to the decoder 37.

The bit streams 36 and 38 may also be transmitted separately through transmission medium 31, as shown by broken lines in FIG. 3.

The output of the decoder 37 is applied to the equalization operator 39 along with the reconstructed signal 133 from the reconstructor 13. The equalization operator 39 outputs the enhanced reconstructed signal 135.

The equalization estimator 33 determines what the equalization operation needs to do in order to produce an enhanced reconstructed signal 135 that matches the target signal 30 more closely than does the reconstructed signal 133. The estimator 33 then outputs an equalization estimation which will maximize a relative similarity measure between the target signal 30 and the enhanced reconstructed signal 135. The equalization estimate output at 34 from estimator 33 is encoded at 35, and the resulting encoded representation output from encoder 35 passes through the transmission medium 31, and is decoded at 37. The reconstructed equalization estimation output from decoder 37 is used by equalization operator 39 to enhance the reconstructed signal 133, resulting in the enhanced reconstructed signal 135.

The equalization function will now be described in more detail. All digital signals are assumed in the examples herein to be sampled at an 8000 Hz sampling rate. In one example implementation of the invention, the target signal and the primary coded signal are processed as a sequence of signal blocks, each signal block including a plurality of samples of the associated signal. The block size can be a frame length, a subframe length, or any desired length therebetween. The signal blocks are time-synchronous for the target and primary coded signals, and corresponding blocks of the target and primary coded signals are referred to as "blocked signal pairs". The signal blocks are chosen to allow exact reconstruction of any signal by simply positioning the corresponding signal blocks timewise end-to-end. The above-described block processing techniques are well-known in the art. The equalization estimation (see 33 in FIG. 3), the coding and decoding of the estimation (see 35 and 37 in FIG. 3), and the enhancement (e.g. equalization) operation (see 21 of FIG. 2 and 39 of FIG. 3) are preferably performed separately for each blocked signal pair.

Block processing as described above may not be suitable in some applications because of disadvantageous blocking effects. In such cases, the signals can be processed using conventional windowing techniques, for example, the well-known Hann window of length L (for example 256) samples with an overlap between windows of L/2 (in this example 128) samples to avoid blocking effects.

Figure 4:
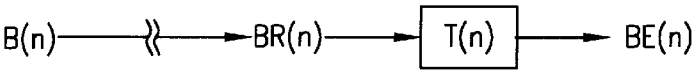
FIG. 4 is a Fourier transform domain illustration of the enhancement function of FIG. 2.

FIG. 4 conceptually illustrates the blocked signals after being transformed into a frequency domain representation using the Fourier transform. B(n) denotes the discrete complex spectrum of the (discrete and real) target signal, and BR(n) denotes the discrete complex spectrum of the (discrete and real) reconstructed signal. The equalization operation in this example is the multiplication of the reconstructed signal BR(n) by a discrete coded spectrum T(n). Thus, the enhanced reconstructed signal BE(n) is given by:

$$BE(n)=T(n)BR(n)\ n=0, \ldots, N-1.$$

T(n) must be symmetric in both the real and imaginary parts to ensure that BE(n) corresponds to a real time-domain signal. For the common situation where BR(n) does not vanish for n=0, . . . , N−1, the optimal representation of T(n) (providing exact reconstruction of the original signal B(n)) is obtained by setting BE(n)=B(n) in the above equation, and solving for T(n):

$$T_{OPT}(n)=B(n)/BR(n)\ n=0, \ldots, N-1;\ BR(n)\neq 0.$$

The goal is to find a coded representation of T(n) which maximizes a relevant similarity measure between BE(n) and B(n). The criterion is advantageously based on human perception. The choice for the format of this coded representation will depend on the particular primary coder used to produce the primary coded signal.

The implementations of equalization operators described herein were developed for use with the LPAS coding paradigm as the primary coder. Perceptual experiments indicate that, in this case, manipulating the phase spectrum of $T_{OPT}(n)$ does not affect the equalization performance significantly. Thus, only the magnitude spectrum of $T_{OPT}(n)$ is used in the disclosed implementations.

The inverse discrete Fourier transform of the inverse power spectrum $|T_{OPT}(n)|^{-2}$ results in an autocorrelation sequence, from which predictor coefficients can be computed using conventional methods well-known to workers in the art, such as the Levinson-Durbin algorithm. The predictor coefficients correspond to an all-pole filter having an absolute discrete transfer function |H(n)|. The inverse power spectrum $|H(n)|^{-2}$ then forms an approximation to $|T_{OPT}(n)|^2$. The filter H(n) can be, for example, a twentieth order filter. An advantage of using |H(n)| to approximate |T(n)| is best understood by recognizing that, for example, if a block of 80 samples is used for each blocked signal B(n) and BR(n), then |T(n)| will be defined by 40 values, whereas |H(n)| will be defined by only 20 values (that is, predictor coefficients) corresponding to the twentieth order all-pole filter represented by H(n).

The all-pole filter |H(n)| ultimately obtained from the inverse power spectrum $|T_{OPT}(n)|^{-2}$ above is effective to reproduce spectral valleys, and thus works well when coding a music signal. If the objective is to improve background noise performance, the spectral peaks are more important. In this case, the power spectrum $|T_{OPT}(n)|^2$ would be used to produce the autocorrelation sequence and, ultimately, the desired all-pole filter.

Figure 5:
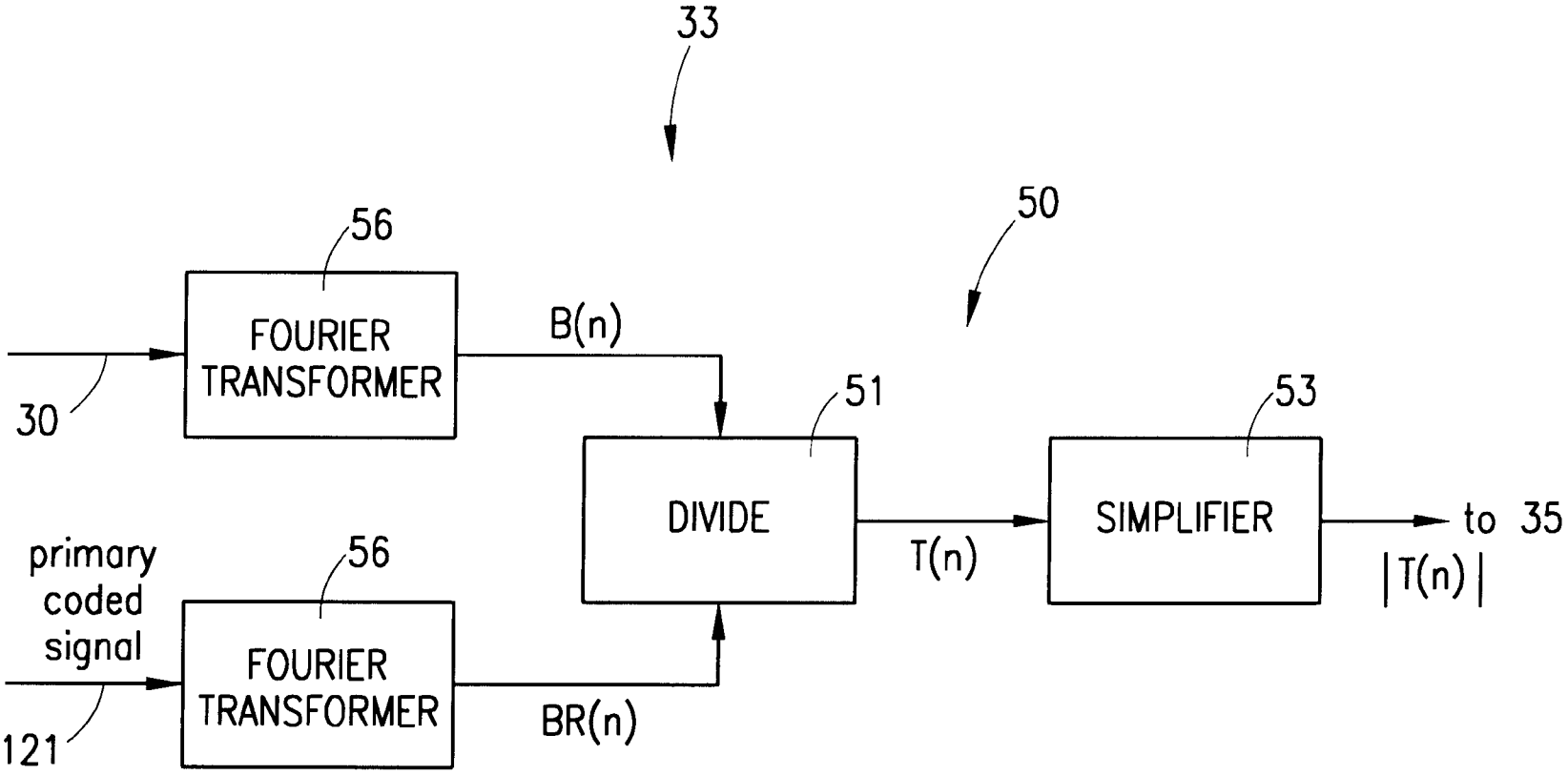
FIG. 5 illustrates an embodiment of the equalization operation estimator of FIG. 3.

FIG. 5 illustrates one example of the estimator 33 of FIG. 3. The target signal blocks and the primary coded signal blocks are pairwise Fourier transformed at 56 (other suitable frequency domain transforms may also be used) to produce the signals B(n) and BR(n), which are applied to a dividing apparatus 50 including a divider 51 and a simplifier 53. B(n) is divided by BR(n) at divider 51 to produce T(n), and the phase information is discarded by simplifier 53, so that only the magnitude information |T(n)| is provided to the encoder 35.

Figure 6:
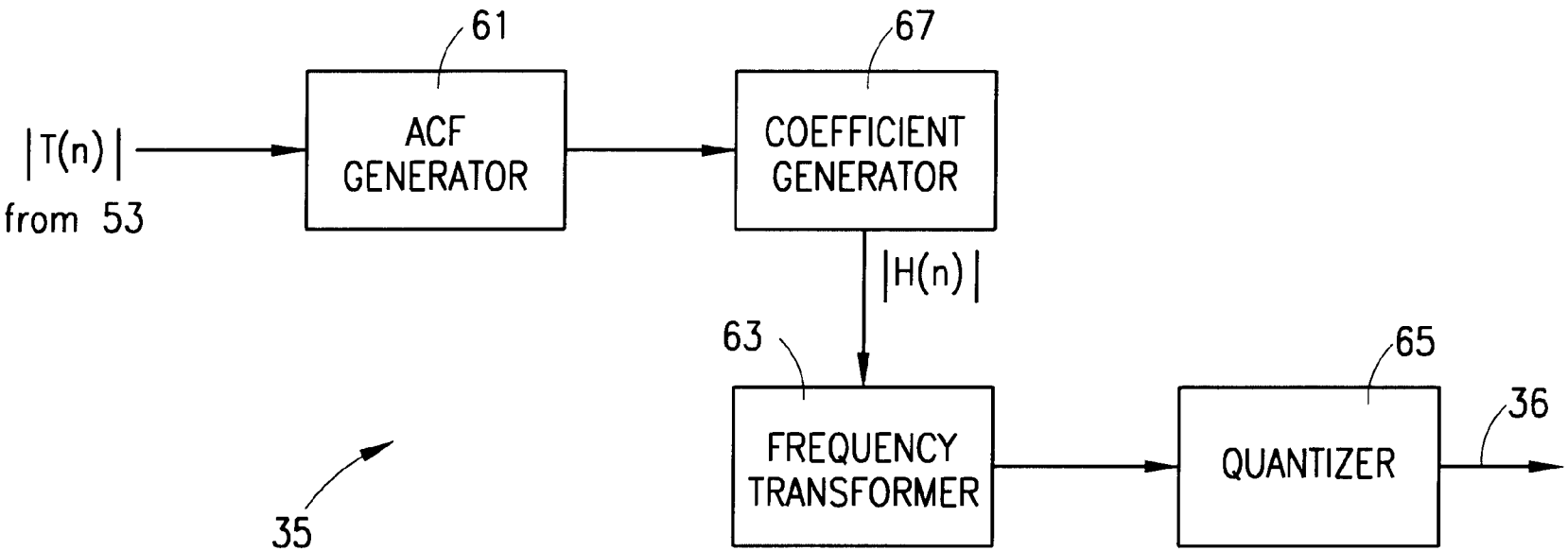
FIG. 6 illustrates the equalization encoder of FIG. 3 in more detail.

Encoder 35 receives |T(n)| and produces |H(n)|. FIG. 6 shows an example of the encoder 35 of FIG. 3. The encoder example of FIG. 6 includes an autocorrelation function (ACF) generator 61 having |T(n)| as an input, and whose output feeds a coefficient generator 67, whose output feeds a frequency transformer 63, whose output feeds a quantizer 65.

Figure 7:
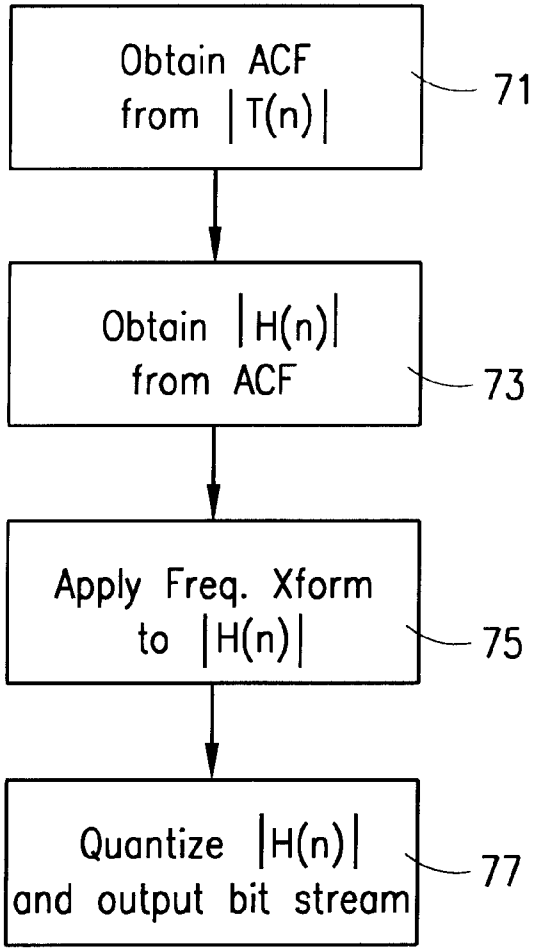
FIG. 7 illustrates the functional operation of the encoder of FIG. 6.

Example operations of the encoder of FIG. 6 are illustrated in example FIG. 7. At 71, the autocorrelation function ACF is obtained from |T(n)| by autocorrelation function generator 61 in the manner described above. At 73, |H(n)| is obtained from the autocorrelation function ACF by coefficient generator 67 in the manner described above. At 75, an appropriate frequency transformation to a perceptually relevant frequency scale (for example, the well-known Bark or ERB scales) is applied to |H(n)| by frequency transformer 63. The coefficients of the resulting frequency-transformed |H(n)| are quantized at 77 by quantizer 65, and a bit stream corresponding to the quantized coefficients is output from the quantizer at 36 (see FIGS. 3 and 6). Many possible quantization approaches can be used, including conventional approaches such as multi-stage and split vector quantization, or simple scalar quantization.

Figure 8:
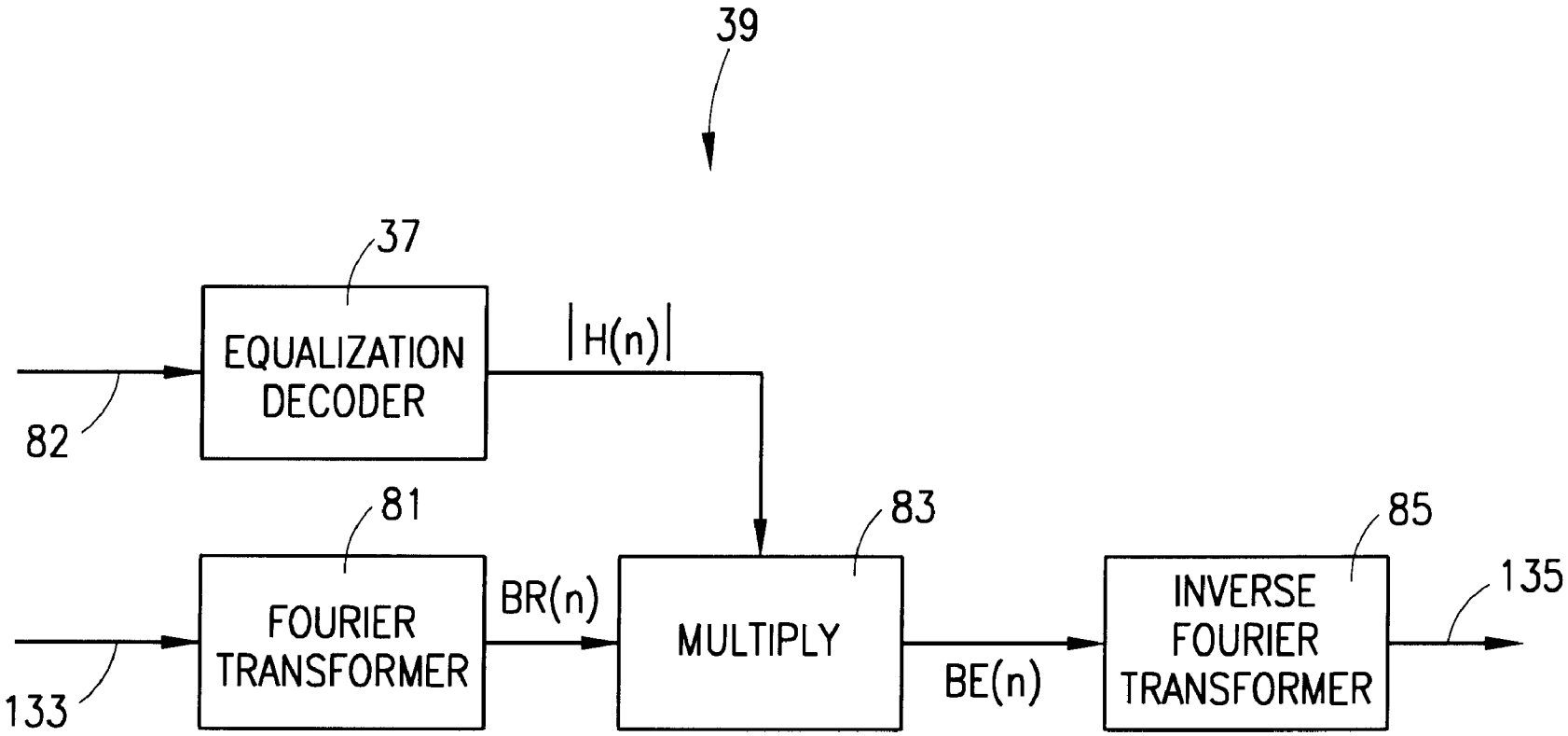
FIG. 8 illustrates an embodiment of the equalization operator of FIG. 3.

FIG. 8 illustrates an example of the equalization operator 39 of FIG. 3. The reconstructed signal at 133 is Fourier transformed at 81 (other suitable frequency domain transforms may also be used as appropriate to match the transform used at 56 in FIG. 5) to produce BR(n). The decoder 37 receives at 82 the encoded |H(n)| (i.e., bit stream) from the transmission medium 31 and can use well-known conventional decoding techniques to produce |H(n)| as an output thereof. The multiplier 83 receives |H(n)| and BR(n) as inputs, and multiplies |H(n)| by BR(n) to produce BE(n). This signal is then inverse Fourier transformed at 85 (other inverse frequency domain transforms may be used to complement the transform used at 81) to produce at 135 the enhanced reconstructed signal in the time domain.

Figure 3A:
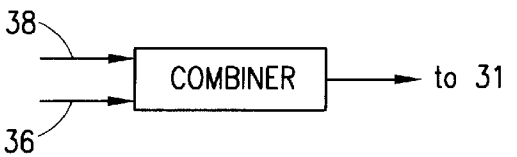
FIG. 3A illustrates a feature of FIG. 3 in greater detail.
Figure 3B:
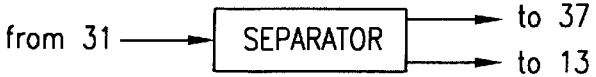
FIG. 3B illustrates a feature of FIG. 3 in greater detail.

If the filter coefficients for |H(n)| are not successfully obtained at the receiver, then the multiplier 83 can automatically set |H(n)|=1, n=0, . . . , N−1. This means that the equalization operator becomes "transparent", inasmuch as the multiplier 83 is merely multiplying the reconstructed signal BR(n) by 1. Thus, if the composite bit stream of FIGS. 3A and 3B is used, the bit stream containing the |H(n)| information (36 in FIG. 3) can be dropped (if desired) to lower the bit rate, without affecting the receiver's ability to reconstruct the primary coded signal.

Figure 9:
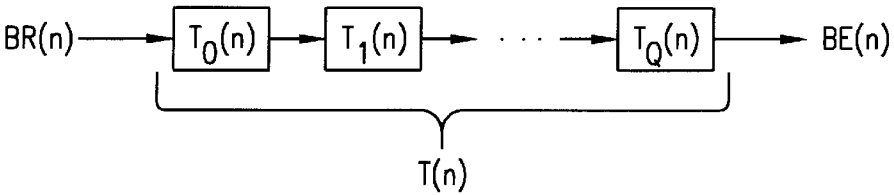
FIG. 9 illustrates a multi-stage implementation of the transfer function of FIG. 4.

FIG. 9 illustrates a multiple stage implementation of the transfer function T(n) of FIG. 4. In FIG. 9, T(n) includes Q+1 stages $T_0(n)$, $T_1(n)$ . . . $T_Q(n)$.

Figure 10:
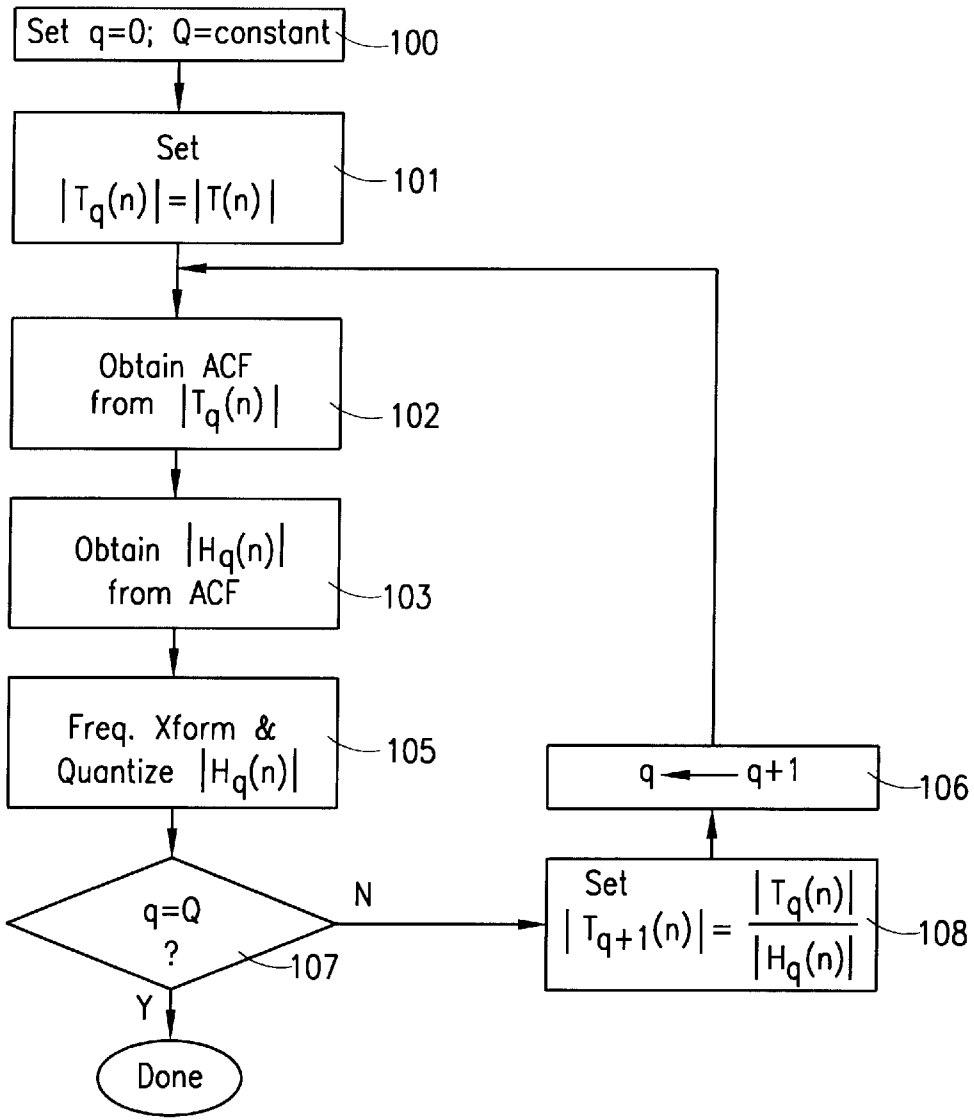
FIG. 10 illustrates the operation of the encoder of FIG. 6 when implementing the multi-stage transfer function of FIG. 9.

FIG. 10 illustrates exemplary operations of the encoder of FIG. 6 to implement the multiple stage transfer function of FIG. 9. At 100 in FIG. 10, an index counter q is set to 0, and Q is assigned a constant value representative of the final stage of the transfer function of FIG. 9. At 101, $|T_q(n)|$ is set to be equal to the desired overall |T(n)| as received from simplifier 53 of FIG. 5. At 102, an autocorrelation function ACF is obtained from $|T_q(n)|$ as described above. At 103, the predictor coefficients of $|H_q(n)|$ are obtained from the ACF as described above. At 105, $|H_q(n)|$ is frequency transformed and quantized as described above. At 107, if the stage index q is equal to the constant Q, then the encoding operation is complete. Otherwise, at 108, $|T_{q+1}(n)|$ is set to be equal to $|T_q(n)|/|H_q(n)|$. Thereafter, stage index q is incremented at 106, the autocorrelation function ACF is obtained from $|T_q(n)|$ at 102, and the procedure is repeated until $|H_q(n)|$ has been obtained for q=0 through q=Q. After completing the encoder operation of FIG. 10, T(n) is approximated by the expression shown below:

$$|T(n)| \approx \prod_{q=0}^{Q} |H_q(n)|$$

Note that, for each $|T_q(n)|$, the encoder operation of FIG. 10 derives the corresponding $|H_q(n)|$. Thus, the foregoing product represents an approximation of the desired |T(n)|.

Figure 11:
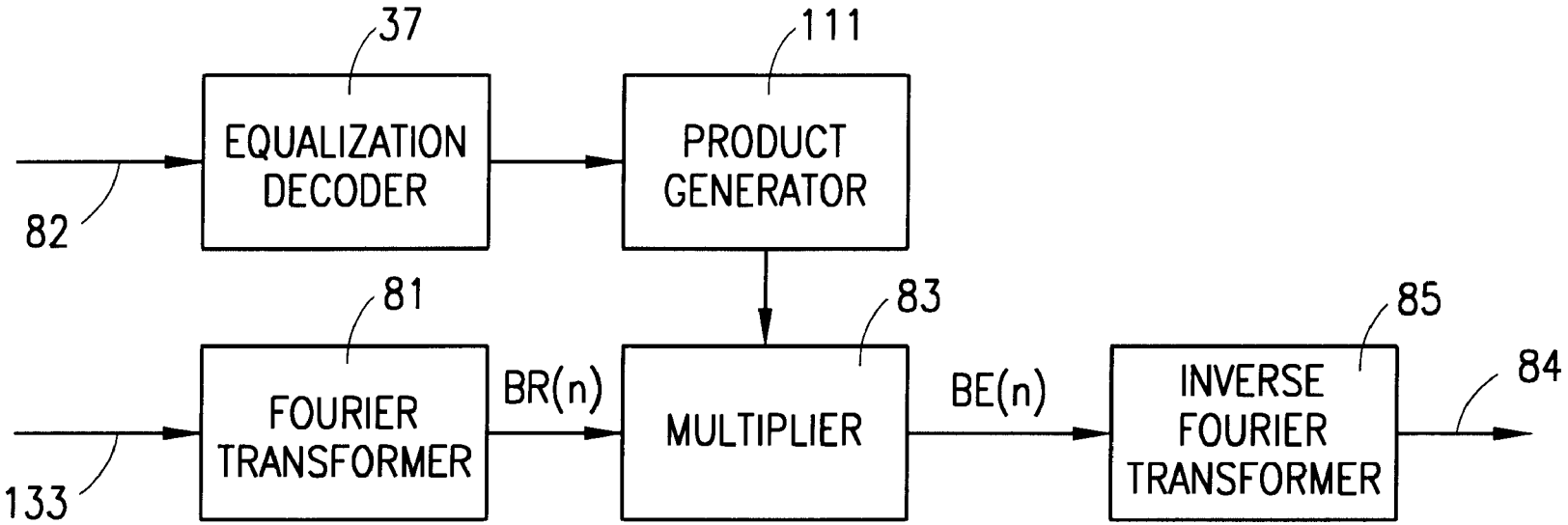
FIG. 11 illustrates a modification of the equalization operator of FIG. 8 to accommodate the multi-stage transfer function of FIG. 9.

FIG. 11 illustrates an example modification to the equalization operator of FIG. 8 to accommodate the multiple stage transfer function of FIG. 9. The output from equalization decoder 37 is input to a product generator 111. The product generator 111 receives from the decoder 37 the stage factors $|H_q(n)|$ in the foregoing product, computes the product, and passes the product to the multiplier 83 to be multiplied by the reconstructed signal BR(n). If the receiver does not successfully obtain all of the stage factors of the foregoing product, then the product generator 111 can replace all unreceived factors with a value of 1 and retain all successfully obtained factors, and then generate the product. The various stages of FIG. 9 can be coded separately at the transmitter and transmitted in embedded fashion such that any one, any group, or all of the stages can be dropped to reduce the bit rate.

Figure 12:
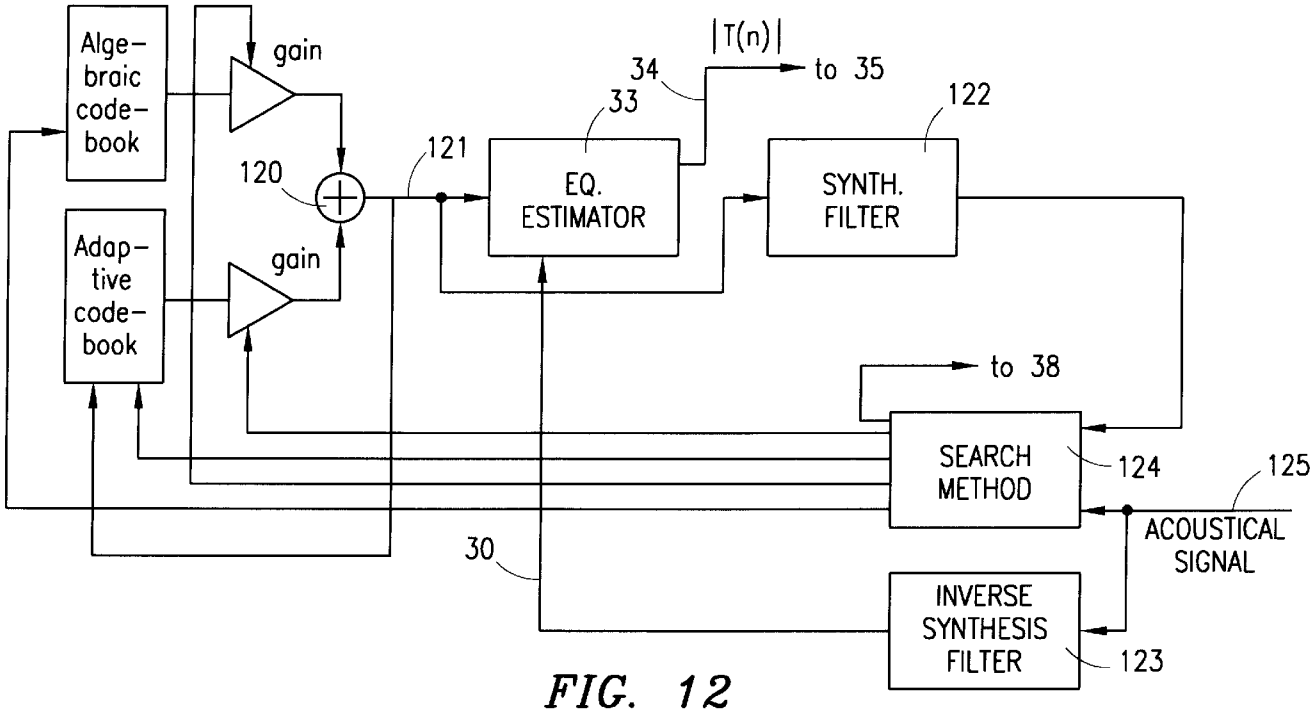
FIG. 12 illustrates a Code-Excited Linear Prediction (CELP) coder according to the present invention including the equalization estimator of FIGS. 3 and 5.

FIG. 12 illustrates one example of a speech coder in a transmitter of a communication system (e.g., a transmitter inside a cellular telephone), including the equalization estimator 33 of FIGS. 3 and 5. The implementation of FIG. 12 includes the conventional ACELP (Algebraic Code Excited Linear Predictive) coding process including an adaptive code book and an algebraic code book. The primary coded signal 121 is obtained at the output of summing circuit 120, is fed back to the adaptive codebook (as is conventional) and is also input to the equalization estimator along with the target signal 30. The target signal represents the excitation that produced the acoustical signal 125, and is obtained by applying the acoustical signal to an inverse synthesis filter 123 which is the inverse of the synthesis filter 122. The acoustical signal 125, which corresponds to the input signal of FIGS. 1 and 3, can include, for example, any one or more of voice, music and background noise. The equalization estimator 33 responds to the primary coded signal and the target signal to produce the equalization estimation |T(n)|. The equalization estimation constitutes information indicative of how well the primary coded signal 121 matches the target signal 30, and thus how well the primary coded signal represents the acoustical signal 125. The conventional search method section 124 of FIG. 12 generates the information (from which the primary coded signal is to be reconstructed at the receiver) for above-described bit stream 38 in a manner well-known in the art. The search method section 124 also controls the codebooks and their associated amplifiers in a conventional manner.

Figure 13:
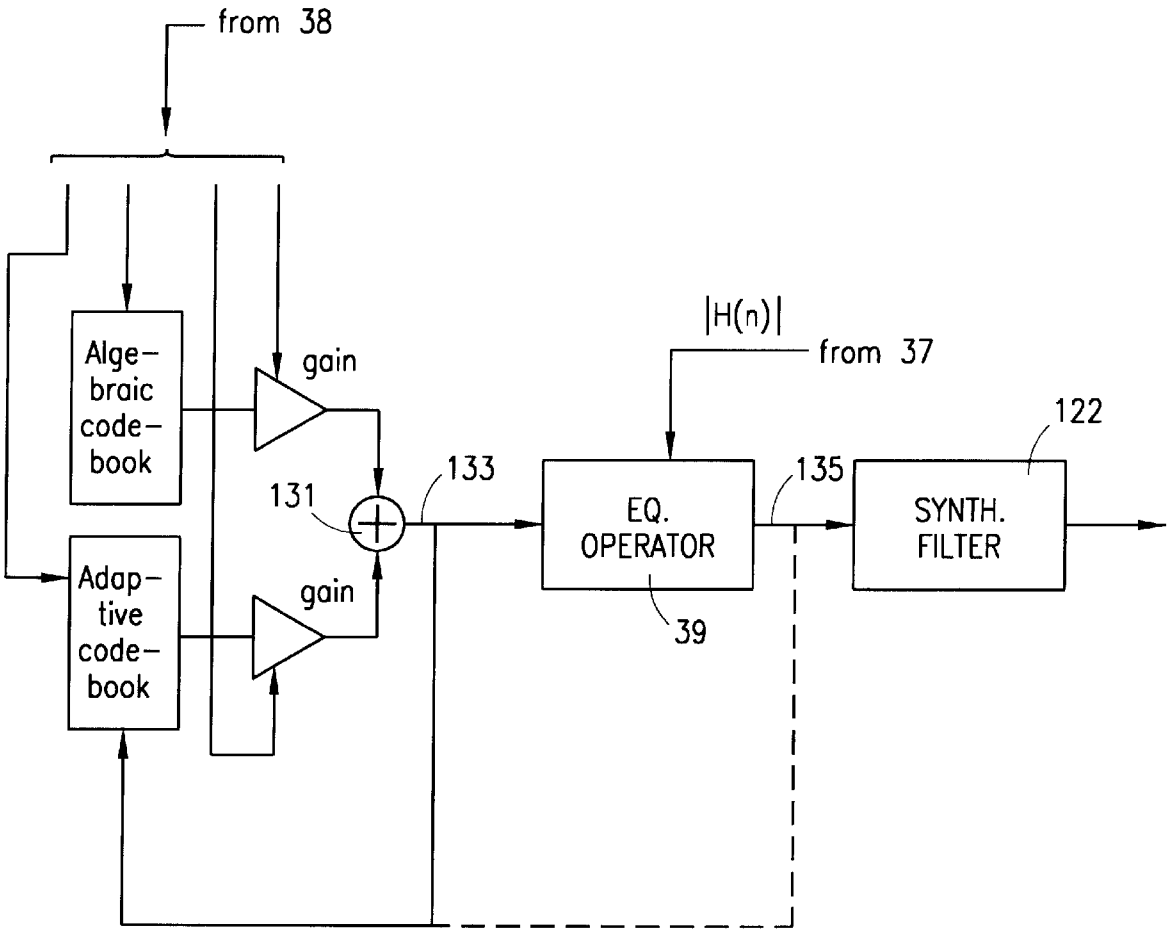
FIG. 13 illustrates a CELP decoder according to the present invention including the equalization operator of FIGS. 3, 8 and 11.

Example FIG. 13 illustrates one example of a speech decoder in a receiver of a communication system (e.g., a receiver in a cellular telephone), including the equalization operator of FIGS. 3, 8 or 11. The FIG. 13 example utilizes the conventional ACELP decoding process including an adaptive code book and an algebraic code book. The reconstruction 133 of the primary coded signal 121 (see FIG. 3) is obtained at the output of the summing circuit 131, and is input to the equalization operator 39. The equalization operator also receives |H(n)| from the equalization decoder 37. In response to these inputs, the equalization operator produces at 135 the enhanced reconstructed signal of FIGS. 2 and 3, which is then input to the conventional synthesis filter 122. The information in bit stream 38 (as received from transmission medium 31) is conventionally demultiplexed and decoded (not shown) to produce conventional control to the codebooks and their amplifiers.

Although the reconstructed signal at 133 (the ACELP excitation signal) that is fed back into the adaptive code book in FIG. 13 is not enhanced by the equalization operator, it is possible (see broken line in FIG. 13) to feed back the enhanced signal 135 from the equalization operator to the adaptive code book. One way to make this practical is to set the block length to the subframe length so that the transmitter estimates the equalization operator for each subframe. Another approach is to interpolate the equalization operator on a subframe basis at the decoder 37, so that the receiver effectively processes blocks of subframe length, regardless of the block length used by the transmitter. If the enhanced signal 135 is fed back to the adaptive codebook, then the bit stream with the $|H(n)|$ information cannot be dropped to lower the bit rate, because it is used to produce the reconstructed signal at 133.

Figure 12A:
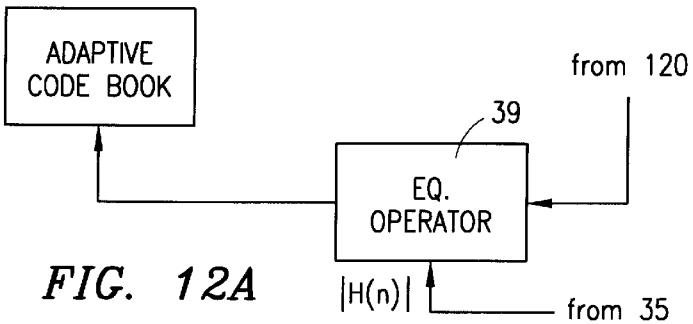
FIG. 12A illustrates an alternative embodiment of the coder of FIG. 12.

If the enhanced signal 135 of FIG. 13 is fed back to the adaptive codebook, then the equalization operator 39 must be inserted in the feedback loop of the speech coder at the transmitter. As an example, the equalization operator 39 can be inserted in the feedback loop of FIG. 12, as shown in FIG. 12A.

The adaptive coded equalizer operator described above performs a linear or non-linear filtering or an approximation thereof on the signal coded by a primary coder, such that the resulting enhanced signal is more similar, according to some criterion, to the target signal. This structure results in several advantages. The multiplicative nature of the coded equalizer allows, at the same bit rate, a much larger dynamic range of the corrections than that of an additive correction to the signal coded by the primary coder. This is particularly advantageous in the coding of acoustic signals, since the human auditory system has a large dynamic range.

The transfer function of the coded equalization operation can be decomposed into a magnitude and a phase spectrum. The phase spectrum essentially determines the time displacement of events in the time-frequency plane. It was found experimentally that most coders replacing the optimal phase spectrum of the transfer function by a zero phase spectrum (or any other spectrum with a small and smooth group delay) results in only a minor drop in performance. Thus, only the magnitude spectrum needs to be coded. This contrasts with systems which correct a primary signal by adding another signal. The coding of the added signal cannot exploit the insensitivity of the human auditory system to small time displacements of events in the time-frequency plane.

If the coded equalizer operator is combined with LPAS coding, inherent weaknesses of the LPAS paradigm can be removed. Thus, the coded equalizer operator allows the accurate description of spectral valleys. Furthermore, it allows the accurate modeling of non-harmonic peaks within a harmonic structure.

The coded equalization method can be used to compensate for shortcomings in a primary coder and thereby give higher performance by focusing on the problems in a coding model. This is especially clear in the CELP context, where transform domain coded equalization is used to improve performance for non-speech signals (e.g., music and background noise) not well coded by the time domain CELP model. Even clean speech performance is improved as the result of the new coding model.

The coded equalizer operator is multiplicative in nature as opposed to earlier additive methods. This means that, for instance, magnitude and phase information can be separated and coded independently. Usually the phase information can be omitted which is not possible with earlier methods.

The coded equalizer operator can easily operate in an embedded mode. The bits can then be dropped due to, e.g., channel errors or a need to lower the bit rate, whereupon the coded equalizer operator becomes transparent and a reasonably good decoded signal is still obtained from the primary decoder.

It will be evident to workers in the art that the embodiments described above with respect to FIGS. 2–13 can be readily implemented using, for example, a suitably programmed digital signal processor or other data processor, and can alternatively be implemented using, for example, such suitably programmed processor in combination with additional external circuitry connected thereto.

Although exemplary embodiments of the present invention have been described above in detail, this does not limit the scope of the invention, which can be practiced in a variety of embodiments.

What is claimed is:

1. A transmitter for encoding an input signal to produce encoded information for transmission over a transmission medium, comprising:

a primary coder having an input to receive the input signal, having a first output for providing a target signal in response to the input signal, having a second output for providing in response to the input signal a primary coded signal that is intended to match the target signal, and having a third output responsive to said input signal for providing encoded information from which said primary coded signal is to be reconstructed;

an enhancement estimator having an input for receiving said primary coded signal and said target signal from said primary coder, said enhancement estimator having an output responsive to said primary coded signal and said target signal for providing enhancement information indicative of how well said primary coded signal matches said target signal;

an encoder having an input for receiving said enhancement information from said enhancement estimator, and having an output for providing an encoded representation of said enhancement information; and an output for outputting said encoded information from which said primary coded signal is to be reconstructed from said primary coder to the transmission medium, and for outputting said encoded representation of said enhancement information from said encoder to the transmission medium.

2. The transmitter of claim 1, wherein said transmitter is provided in a cellular telephone.

3. The transmitter of claim 1, wherein said input signal is an acoustical signal and said primary coder executes a linear predictive coding process.

4. The transmitter of claim 1, wherein said estimator includes a frequency domain transformer for forming respective frequency domain transforms of said target signal and said primary coded signal.

5. The transmitter of claim 4, wherein said estimator includes a dividing apparatus coupled to said transformer for dividing one of said transformed signals by the other of said transformed signals to produce said enhancement information, including information about a desired transfer function.

6. The transmitter of claim 5, wherein said encoder is coupled to said dividing apparatus and responsive to said information about said desired transfer function for generating an approximation function which approximates said desired transfer function.

7. The transmitter of claim 6, wherein said encoder includes an autocorrelation function generator for receiving said information about said desired transfer function and generating an autocorrelation function therefrom.

8. The transmitter of claim 7, wherein said approximation function is a filter function, and wherein said encoder includes a coefficient generator coupled to said autocorrelation function generator and responsive to said autocorrelation function for generating filter coefficients that define said approximation function.

9. The transmitter of claim 8, wherein said encoder includes a frequency transformer coupled to said coefficient generator for performing a frequency transformation on said filter coefficients to produce a frequency transformed approximation function.

10. The transmitter of claim 9, wherein said encoder includes a quantizer coupled to said frequency transformer for quantizing the filter coefficients of the frequency transformed approximation function.

11. The transmitter of claim 6, wherein said encoder provides said approximation function formatted as a series of successive approximation stages which collectively define said approximation function.

12. The transmitter of claim 5, wherein said information about said desired transfer function includes only magnitude information about the desired transfer function.

13. The transmitter of claim 1, including a combiner having an input coupled to said primary coder for receiving said encoded information about said primary coded signal and having an input coupled to said encoder for receiving said encoded representation of said enhancement information, said combiner having an output for providing a composite signal having a primary portion corresponding to said encoded information about said primary coded signal and having an auxiliary portion corresponding to said encoded representation of said enhancement information, said combiner output coupled to said output of said transmitter.

14. The transmitter of claim 4, wherein said frequency domain transformer includes a Fourier transformer for forming a Fourier transform.

15. A receiver for receiving and decoding encoded information from a transmission medium, comprising:

a reconstructor having an input for receiving a portion of said encoded information and having an output for providing in response to said encoded information a reconstructed signal that is intended to match a target signal;

a decoder having an input for receiving a portion of the encoded information and having an output for providing in response to said encoded information enhancement information indicative of how well said reconstructed signal matches said target signal; and an enhancer for receiving said reconstructed signal and said enhancement information from said reconstructor and said decoder, and having an output responsive to said reconstructed signal and said enhancement information for producing an enhanced reconstructed signal that matches the target signal more closely than does said reconstructed signal.

16. The receiver of claim 15, wherein said enhancer includes a frequency domain transformer coupled to said reconstructor for forming a frequency domain transform of said reconstructed signal.

17. The receiver of claim 16, wherein said enhancer includes a multiplier coupled to said transformer and to said decoder for multiplying said transformed reconstructed signal by said enhancement information.

18. The receiver of claim 17, wherein said enhancement information includes filter coefficients that define a filter.

19. The receiver of claim 17, wherein said enhancer includes an inverse frequency domain transformer coupled to said multiplier for forming an inverse frequency domain transform of an output signal produced by said multiplier.

20. The receiver of claim 17, wherein said enhancement information describes a multi-stage filter having a plurality of filter stages, said enhancer including a product generator coupled to said decoder and responsive to said enhancement information for generating a product of filter stage transfer functions that define the respective stages of said multi-stage filters said product corresponding to an overall filter transfer function that defines said multi-stage filter, said product generator having an output coupled to said multiplier to provide said overall filter transfer function to said multiplier.

21. The receiver of claim 20, wherein said product generator is selectively operable to exclude any of said filter stage transfer functions from said product.

22. The receiver of claim 15, wherein said receiver is provided in a cellular telephone.

23. The receiver of claim 15, wherein said target signal is a representation of an acoustical signal and said reconstructor executes a linear predictive coding process.

24. The receiver of claim 15, wherein said enhancer is selectively operable to permit said reconstructed signal to negotiate said enhancer without being enhanced.

25. The receiver of claim 16, wherein said frequency domain transformer includes a Fourier transformer for forming a Fourier transform.

26. The receiver of claim 19, wherein said inverse frequency domain transformer includes an inverse Fourier transformer for forming an inverse Fourier transform.

27. A method of encoding an input signal to produce encoded information for transmission over a transmission medium, comprising:

producing a target signal in response to the input signal;

producing in response to the input signal a primary coded signal that is intended to match the target signal;

producing in response to the input signal encoded information from which the primary coded signal is to be reconstructed;

producing, in response to the primary coded signal and the target signal, enhancement information indicative of how well the primary coded signal matches the target signal;

producing an encoded representation of the enhancement information; and outputting to the transmission medium the encoded representation of the enhancement information and the encoded information from which the primary coded signal is to be reconstructed.

28. The method of claim 27, wherein said step of producing enhancement information includes forming respective frequency domain transforms of the target signal and the primary coded signal.

29. The method of claim 28, wherein said step of producing enhancement information includes dividing one of the transformed signals by the other of the transformed signals to produce information about a desired transfer function.

30. The method of claim 29, wherein said step of producing an encoded representation includes generating an approximation function which approximates the desired transfer function.

31. The method of claim 30, wherein said step of generating an approximation function includes generating an autocorrelation function from said information about the desired transfer function.

32. The method of claim 31, wherein said approximation function is a filter function, and wherein said step of generating said approximation function includes generating, responsive to said autocorrelation function, filter coefficients that define said approximation function.

33. The method of claim 32, wherein said step of generating an approximation function includes performing a frequency transformation on said filter coefficients to produce a frequency transformed approximation function.

34. The method of claim 33, wherein said step of generating an approximation function includes quantizing the filter coefficients of the frequency transformed approximation function.

35. The method of claim 30, wherein said step of generating an approximation function includes formatting the approximation function as a series of successive approximation stages which collectively define the approximation function.

36. The method of claim 27, wherein said outputting step includes producing a composite signal having a primary portion corresponding to the encoded information from which the primary coded signal is to be reconstructed and having an auxiliary portion corresponding to the encoded representation of the enhancement information.

37. The method of claim 27, wherein said outputting step includes operating a transmitter in a cellular telephone.

38. The method of claim 30, wherein said step of generating an approximation function includes using only magnitude information about the desired transfer function to generate the approximation function.

39. The method of claim 27, wherein said input signal is an acoustical signal, and wherein said step of producing said primary coded signal includes executing a linear predictive coding process.

40. The method of claim 28, wherein said step of forming frequency domain transforms includes forming Fourier transforms.

41. A method of decoding encoded information received from a transmission medium, comprising:

reconstructing from said encoded information a reconstructed signal that is intended to match a target signal;

obtaining from the encoded information enhancement information indicative of how well the reconstructed signal matches the target signal; and producing in response to the reconstructed signal and the enhancement information an enhanced reconstructed signal that matches the target signal more closely than does the reconstructed signal.

42. The method of claim 41, wherein said step of producing an enhanced reconstructed signal includes forming a frequency domain transform of the reconstructed signal.

43. The method of claim 42, wherein said step of producing an enhanced reconstructed signal includes multiplying the transformed reconstructed signal by the enhancement information.

44. The method of claim 43, wherein the enhancement information includes filter coefficients that define a filter.

45. The method of claim 43, wherein said step of producing an enhanced reconstructed signal includes producing an inverse frequency domain transform of a multiplication result produced by said multiplying step.

46. The method of claim 43, wherein the enhancement information describes a multi-stage filter having a plurality of filter stages, and wherein said step of producing an enhanced reconstructed signal includes generating a product of filter stage transfer functions that define the respective stages of the multi-stage filter, said product corresponding to an overall filter transfer function that defines the multi-stage filter.

47. The method of claim 46, wherein said step of generating a product includes selectively excluding any of the filter stage transfer functions from the product.

48. The method of claim 41, including selectively foregoing said step of producing an enhanced reconstructed signal.

49. The method of claim 41, wherein said transmission medium is a communication channel of a cellular telephone network.

50. The method of claim 41, wherein the target signal is a representation of an acoustical signal and said reconstructing step includes executing a linear predictive coding process.

51. The method of claim 42, wherein said step of forming a frequency domain transform includes forming a Fourier transform.

52. The method of claim 45, wherein said step of producing an inverse frequency domain transform includes producing an inverse Fourier transform.

* * * * *